US010326246B2

(12) United States Patent
Chang et al.

(10) Patent No.: US 10,326,246 B2
(45) Date of Patent: Jun. 18, 2019

(54) ELECTRICAL CONNECTOR WITH FILTERING FUNCTION

(71) Applicants: U. D. ELECTRONIC CORP., Taoyuan (TW); U. D. (DONGGUAN) ELECTRONIC TECHNOLOGY CORP., Dongguan (CN); U. D. (ZHONG JIANG) ELECTRONIC CORP., Deyang (CN)

(72) Inventors: Chih-Kai Chang, Taoyuan (TW); Shih-Long Zou, Dongguan (CN); Yao-Ching Huang, Taoyuan (TW)

(73) Assignees: U. D. ELECTRONIC CORP. (TW); U. D. (DONGGUAN) ELECTRONIC TECHNOLOGY CORP. (CN); U. D. (ZHONG JIANG) ELECTRONIC CORP. (CN)

( * ) Notice: Subject to any disclaimer, the term of this patent is extended or adjusted under 35 U.S.C. 154(b) by 0 days.

(21) Appl. No.: 16/121,593

(22) Filed: Sep. 4, 2018

(65) Prior Publication Data

US 2019/0089103 A1 Mar. 21, 2019

(30) Foreign Application Priority Data

Sep. 20, 2017 (CN) ..... 2017 2 1205374 U
Sep. 20, 2017 (CN) ..... 2017 2 1205536 U

(51) Int. Cl.

| | |
|---|---|
| ***H01R 13/66*** | (2006.01) |
| ***H01R 13/719*** | (2011.01) |
| ***H01R 13/506*** | (2006.01) |
| ***H01R 13/6581*** | (2011.01) |
| ***H01R 24/86*** | (2011.01) |

(Continued)

(52) U.S. Cl.

CPC ..... *H01R 13/719* (2013.01); *H01R 12/707* (2013.01); *H01R 12/75* (2013.01); *H01R 13/506* (2013.01); *H01R 13/512* (2013.01); *H01R 13/6581* (2013.01); *H01R 13/6658* (2013.01); *H01R 24/86* (2013.01); *H01R 12/724* (2013.01)

(58) Field of Classification Search

CPC . H01R 23/025; H01R 13/514; H01R 13/6633
USPC ..... 439/620.23, 620.17, 620.18
See application file for complete search history.

(56) References Cited

U.S. PATENT DOCUMENTS 9,077,120 B2 * 7/2015 Zhang ..... H01R 13/6658
9,124,043 B2 * 9/2015 Bopp ..... H01R 13/6658
(Continued)

*Primary Examiner* — Phuong Chi T Nguyen

(57) ABSTRACT

An electrical connector with filtering function includes a high-speed interface, a filter module and a hood. The high-speed interface includes an insulating body and connecting terminals; the filter module is installed at a rear end of a circular cross-section of the insulating body; the filter module includes a lid with output terminals and grounding terminals and a horizontally configured PCB; and the grounding terminals include a first connecting end electrically connected to the PCB and a second connecting end integrally connected to the first connecting end and attached onto the external surface of the lid. The hood covers the lid and has a screw hole corresponding to the second connecting end for a locking screw being screwed in, and press tightly at the second connecting end to achieve the grounding and shielding of the PCB by the grounding terminal and the electrical connection of the locking screw to the hood.

10 Claims, 11 Drawing Sheets

(51) Int. Cl.

| | |
|---|---|
| ***H01R 12/70*** | (2011.01) |
| ***H01R 12/75*** | (2011.01) |
| ***H01R 13/512*** | (2006.01) |
| *H01R 12/72* | (2011.01) |

(56) References Cited

U.S. PATENT DOCUMENTS

| | | | | |
|---|---|---|---|---|
| 9,198,289 | B2 * | 11/2015 | Bopp | H01R 13/6466 |
| 9,397,450 | B1 * | 7/2016 | Feng | H01R 13/659 |
| 9,531,109 | B2 * | 12/2016 | Gao | H01R 12/716 |
| 9,660,385 | B2 * | 5/2017 | Bopp | H01R 13/6658 |
| 9,787,015 | B2 * | 10/2017 | Pepe | H01R 13/02 |

* cited by examiner

ELECTRICAL CONNECTOR WITH FILTERING FUNCTION

FIELD OF INVENTION

The present invention relates to an electrical connector, in particular to the electrical connector with a filtering function.

BACKGROUND OF INVENTION

Description of the Related Art

Conventional electrical connectors such as M8 connectors and M12 connectors are pure mechanical connectors formed by a plastic insulator and a plurality of terminals. In general, the connectors formed by such components can be used for the transmission of low-frequency signals only. However, the stability and quality of the signals will be affected adversely in high-frequency transmissions. In certain situations requiring a transmission of high-frequency signals between devices, a common traditional solution is to install an electronic component with a filtering function onto a circuit board of the device. Inevitably, this design has the issues of occupying much interior space of the device and affecting the circuit layout of the device. Therefore, it is a main subject for related manufacturers to integrate a feasible electronic module with a filtering function into an electrical connector to just achieve the effect of miniaturizing the electrical connector as well as simplifying the structure and facilitating the production.

SUMMARY OF THE INVENTION

It is a primary objective of the present invention to overcome the aforementioned drawbacks of the prior art by providing an electrical connector with a filtering function to ensure the miniaturization, simple structure, and easy production of the electrical connector to improve the conventional electrical connector which has a complicated structure, occupies much space, and results in unreliable grounding.

To achieve the aforementioned and other objectives, the present invention provides an embodiment of an electrical connector with a filtering function, comprising: a high-speed interface, further comprising: an insulating body having an end with a circular cross-section, and a plurality of through holes; and a plurality of connecting terminals, installed into the through holes respectively, extended backwardly from the circular cross-section of the insulating body and bent downwardly to form a plurality of soldered ends; a filter module installed at a rear end of the circular cross-section of the insulating body, and including a lid with a plurality of output terminals and at least a grounding terminal, and a PCB electrically coupled to the output terminals and the grounding terminal and configured horizontally; and a hood covering the circular cross-section of the insulating body and the filter module.

Wherein, the PCB has a plurality of electronic components installed thereon; and the output terminals are extended out from a bottom surface of the hood.

Wherein, the grounding terminal includes a first connecting end electrically coupled to the PCB and a second connecting end integrally coupled to the first connecting end, and the second connecting end is attached onto an external surface of the lid.

Wherein, the hood covers the exterior of the lid and has a screw hole formed at a position of the hood and configured to be corresponsive to the second connecting end.

Wherein, a locking screw is screwed tightly into the screw hole to press and connect the second connecting end of the grounding terminal, and the grounding terminal is electrically coupled to the hood through the locking screw Preferably, the external surface of the lid has at least a terminal slot formed thereon and configured to be corresponsive to the second connecting end of the grounding terminal, and the second connecting end is accommodated into the terminal slot Preferably, the high-speed interface includes a M12 interface.

Preferably, the insulating body has a frame integrally formed at an edge of the circular cross-section of the insulating body.

Preferably, the lid of the filter module is inlaid and combined with the frame, and the output terminals are latched onto the lid; the front end of the lid has a notch formed thereon and configured to be corresponsive to the soldered ends; the soldered ends are passed through the notch and extended into the lid, and the soldered end and the output terminals are perpendicular to the bottom surface of the lid and electrically coupled to the PCB.

Preferably, the frame has a latch slot formed on both sides of the frame each, and the lid has a positioning portion disposed on both sides of the front end of the lid and configured to be corresponsive to the latch slot, and the positioning portion is latched into the latch slot.

Preferably, the output terminals include a plurality of POE terminals installed on both sides of the front end of the lid.

Preferably, the bottom of the lid has an accommodating cavity concavely formed on the lid for accommodating the electronic components installed on the PCB.

Preferably, the filter module further includes a base latched to the bottom of the lid, and the PCB is clamped between the base and the lid, and the output terminals (22) are extended out from the bottom surface of the base Preferably, the hood includes a front casing and a rear cover, and the rear cover covers a rear opening of the front casing, and the front casing is fixed and coupled to the rear cover through the locking screw.

Compared with the prior art, the present invention has the following advantages and effects. Specifically, the PCB is electrically coupled to the electronic components and horizontally installed into the electrical connector, and both of the connecting terminal and the output terminal are electrically coupled to the PCB, so as to improve the noise resisting ability, adapt the high-speed transmission, and ensure the miniaturization of the electrical connector. Therefore, the present invention has the advantages of simple and compact structure, simple manufacture, and low cost.

Further, the present invention arranges the first connecting end of the grounding terminal to be electrically coupled to the PCB and the second connecting end attached onto the external surface of the lid. In addition, the hood covers the lid and has the screw hole configured to be corresponsive to the second connecting end. The locking screw is screwed into the screw hole to press onto the second connecting end of the grounding terminals, and the grounding terminal is electrically coupled to the hood through the locking screw, so as to overcome the drawbacks of the conventional complicated structure for grounding electrical connectors, occupying too much space, and having unreliable electrical connections.

DESCRIPTION OF THE PREFERRED EMBODIMENTS

To make it easier for our examiner to understand the objective, technical characteristics, structure, innovative features, and performance of the invention, we use preferred embodiments together with the attached figures for the detailed description of the invention. It is intended that the embodiments and figures disclosed herein are to be considered illustrative rather than restrictive.

Figure 1:
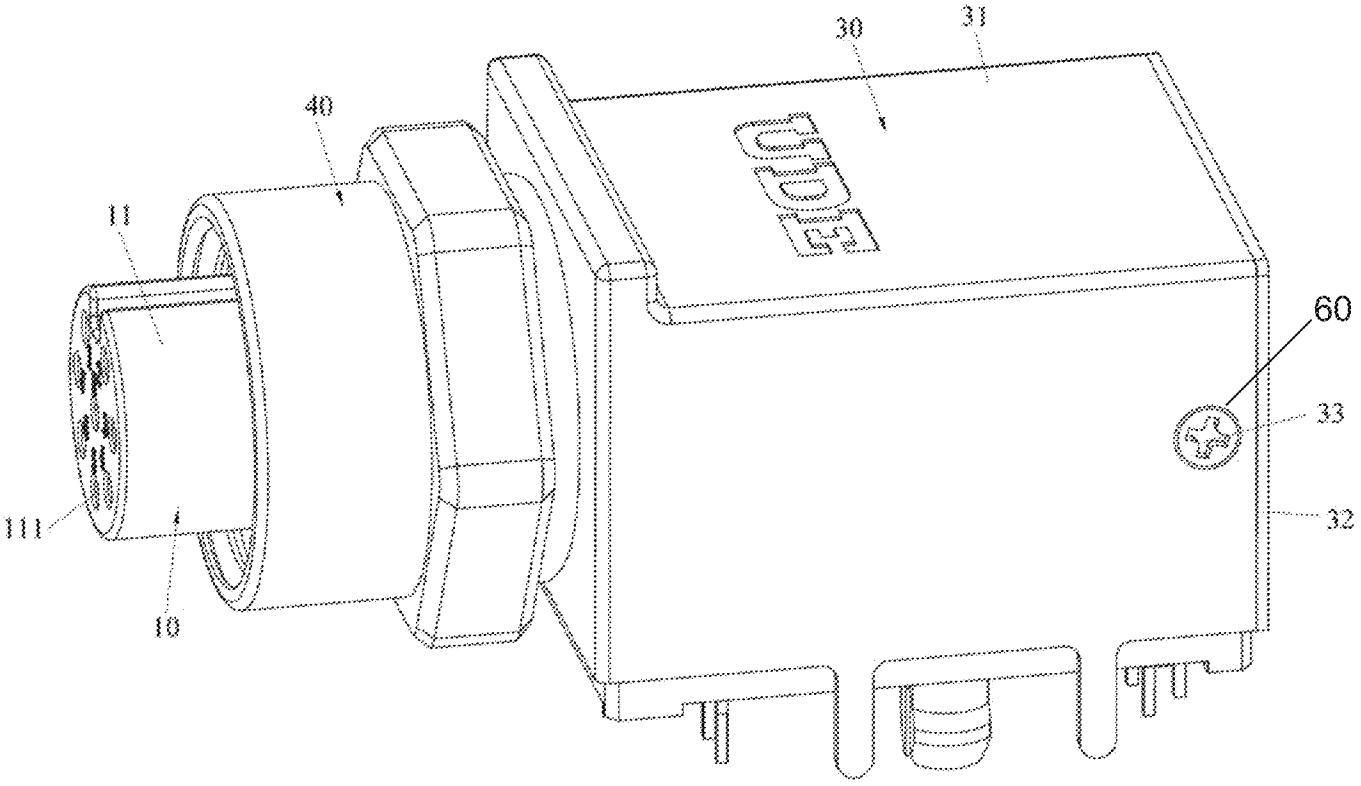
FIG. 1 is a schematic view of an assembly of an electrical connector with a filtering function in accordance with the present invention.
Figure 2:
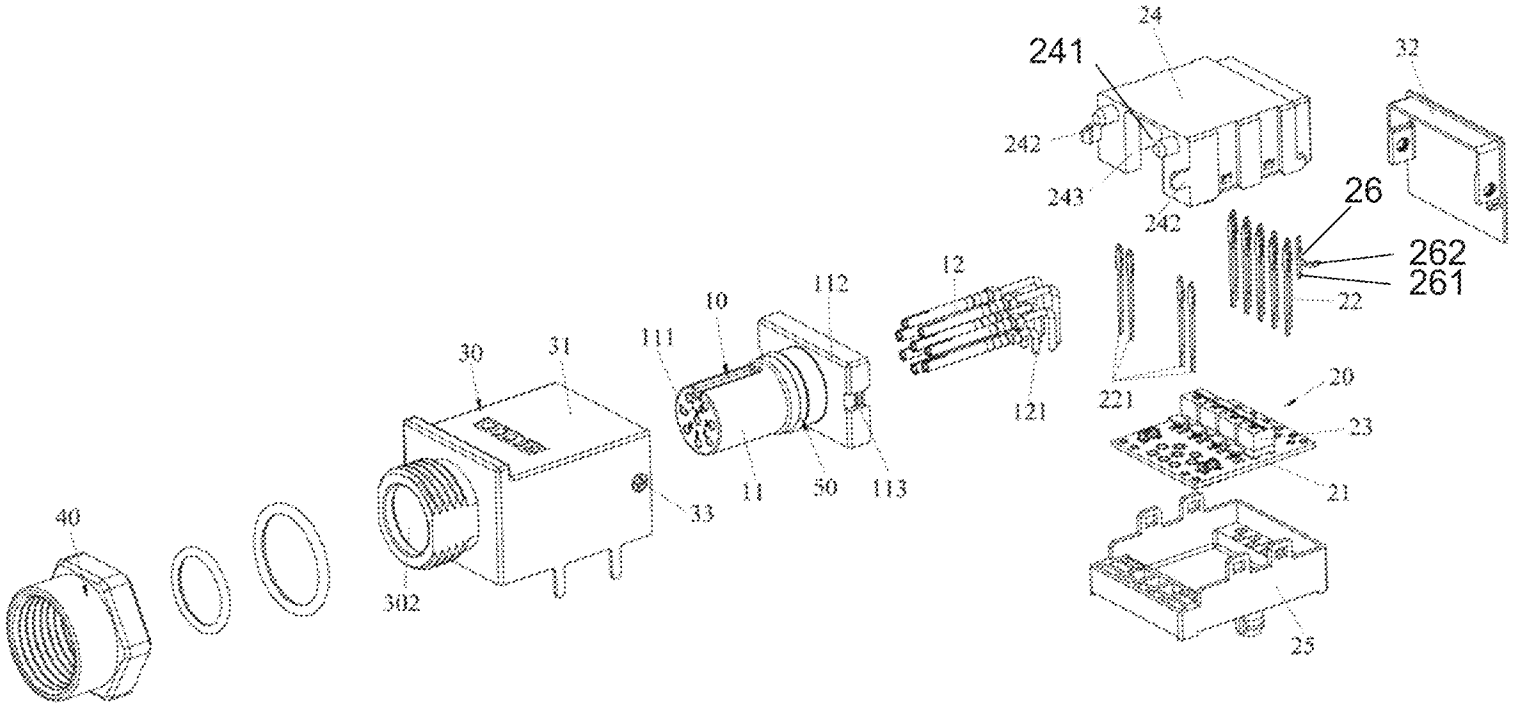
FIG. 2 is a first exploded view of an electrical connector with a filtering function in accordance with the present invention.
Figure 3:
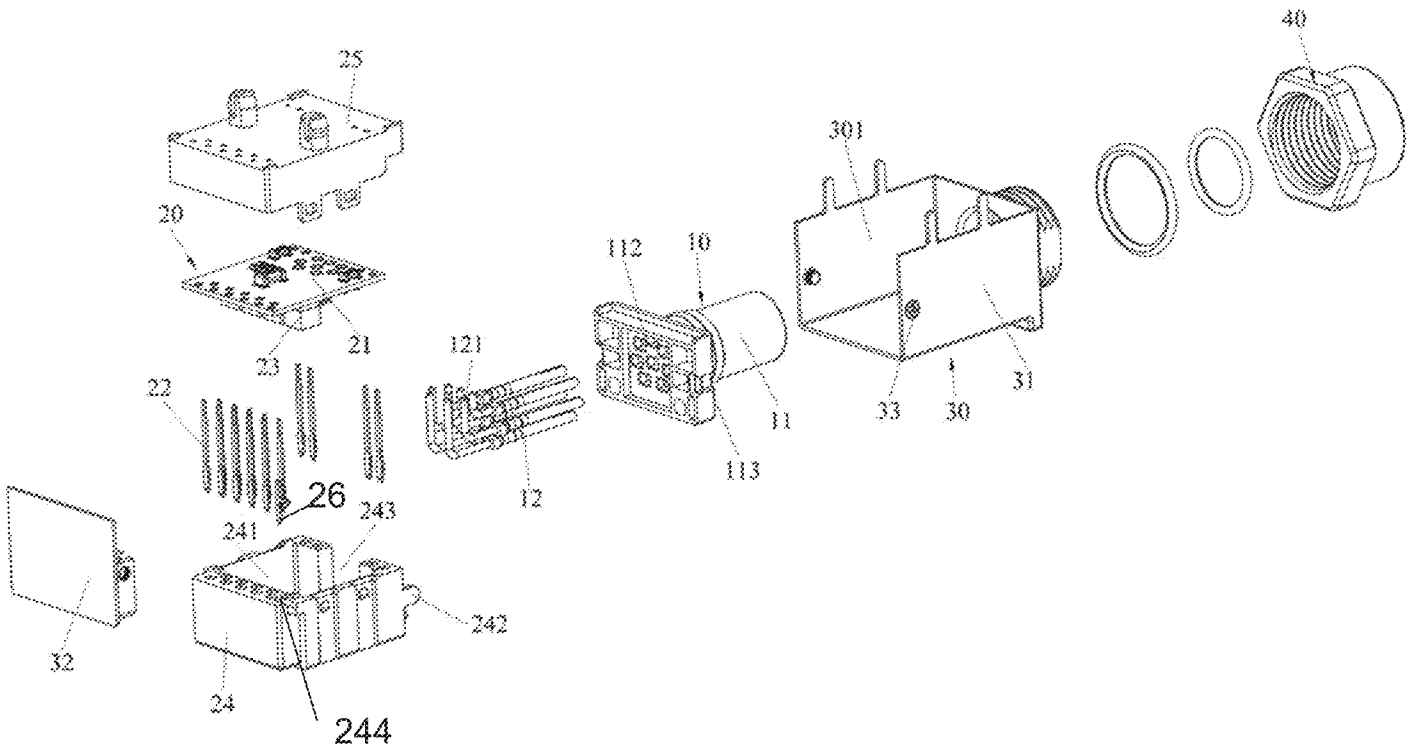
FIG. 3 is a second exploded view of an electrical connector with a filtering function in accordance with the present invention.
Figure 4:
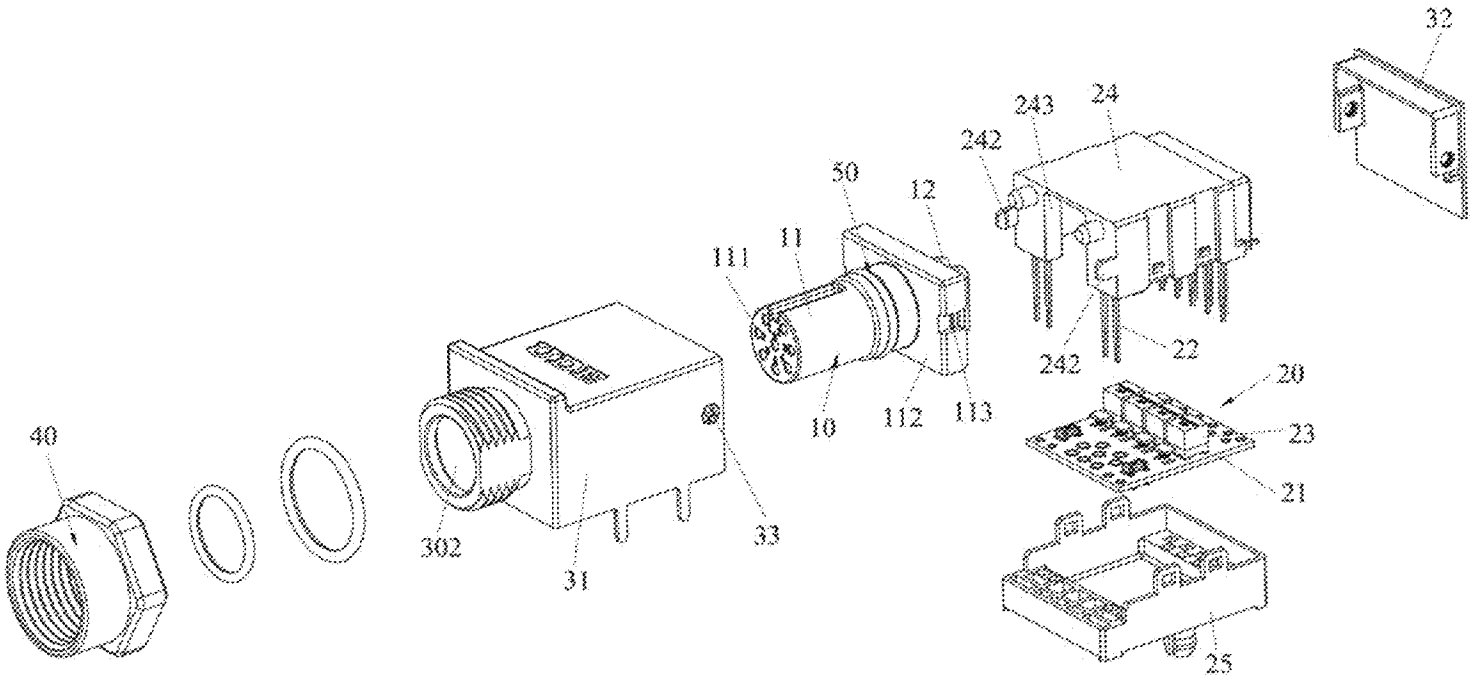
FIG. 4 is a schematic view of a partial assembly of FIG. 3.
Figure 5:
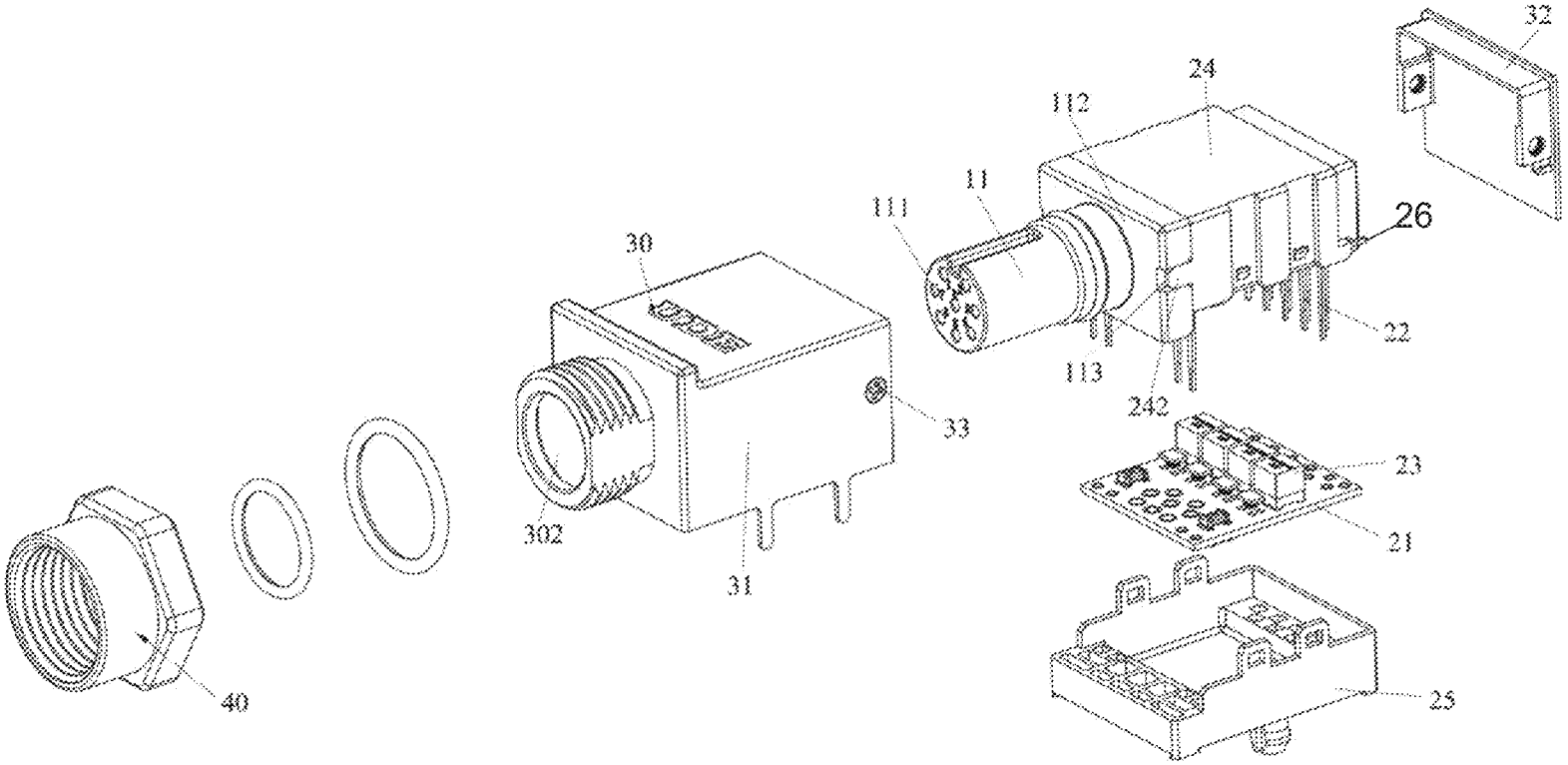
FIG. 5 is a schematic view of a partial assembly of FIG. 4.
Figure 6:
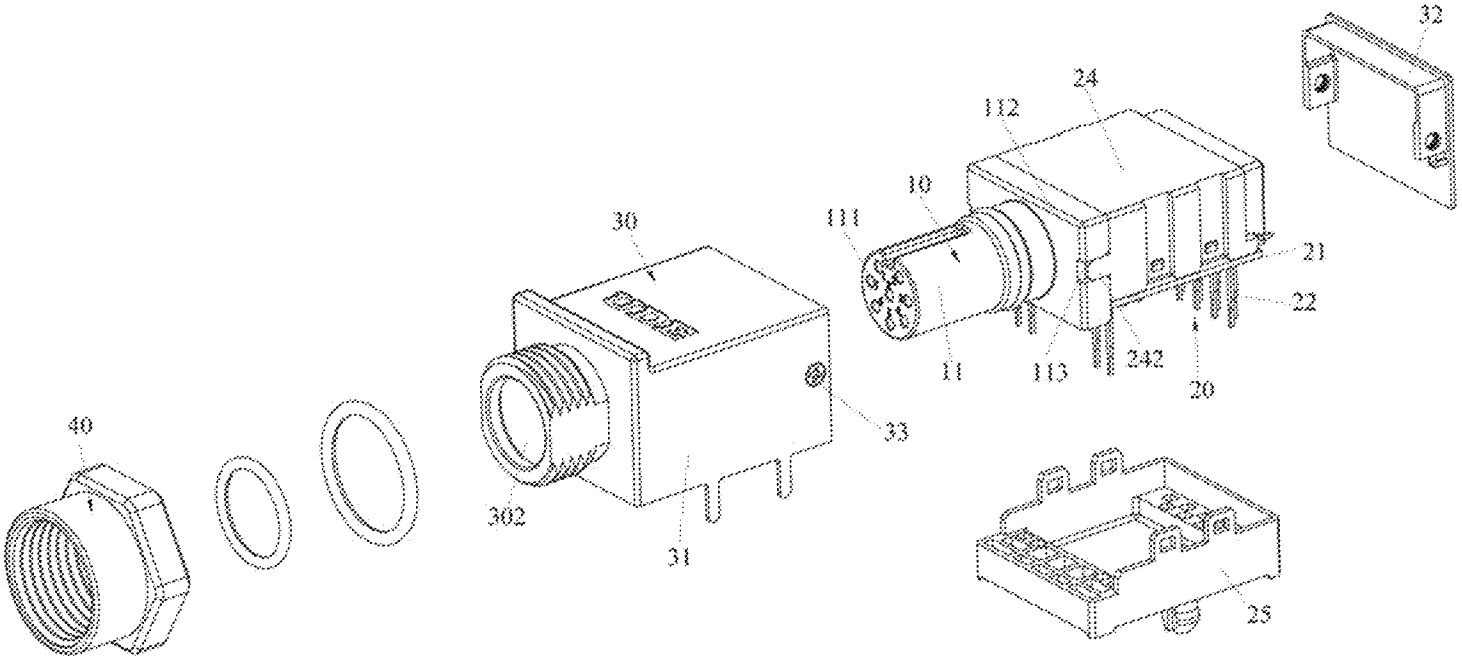
FIG. 6 is a schematic view of a partial assembly of FIG. 5.
Figure 7:
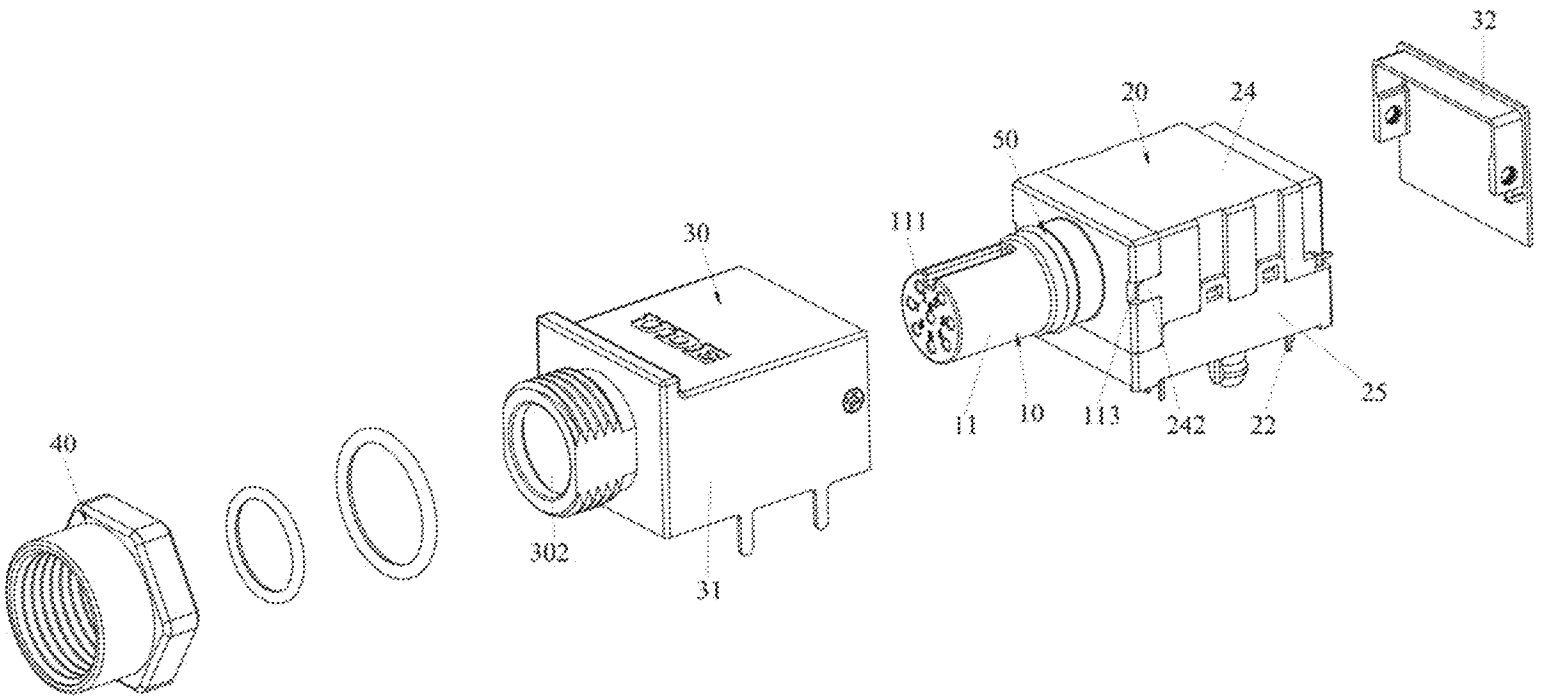
FIG. 7 is a schematic view of a partial assembly of FIG. 6.
Figure 8:
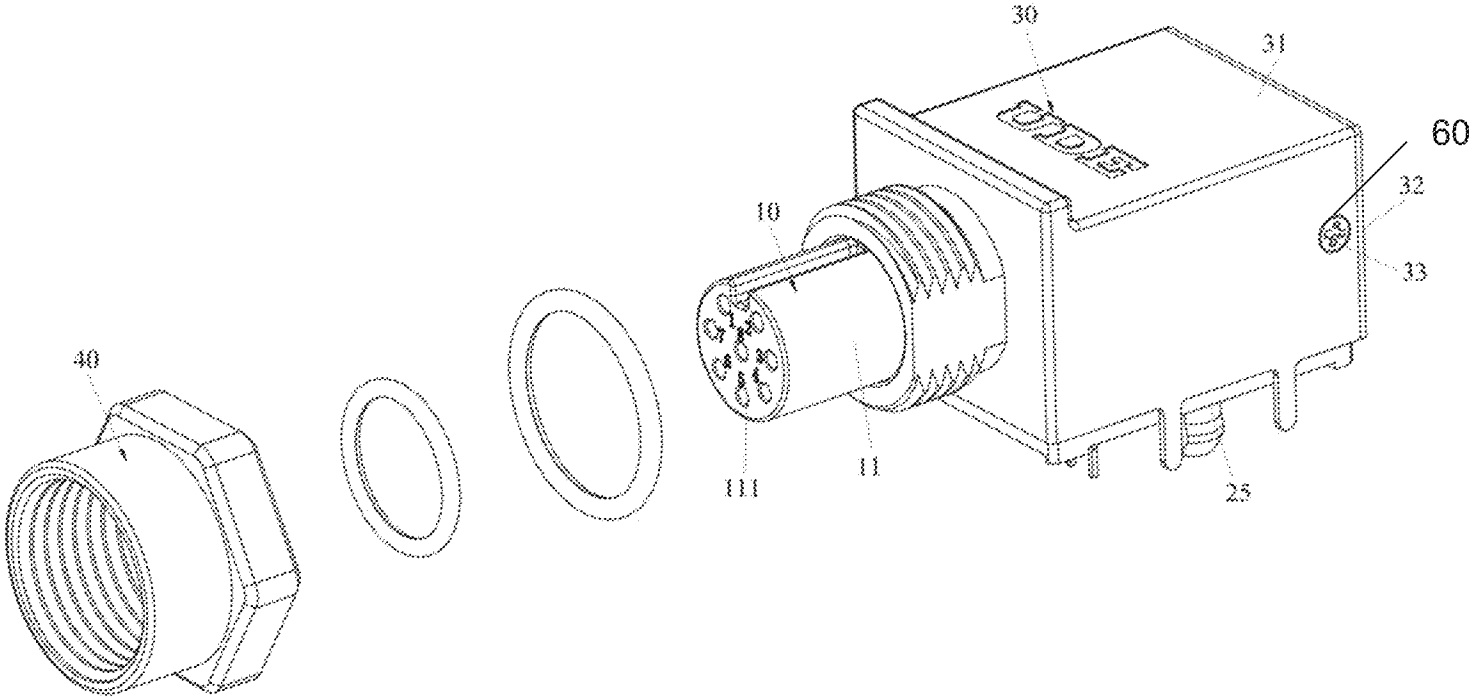
FIG. 8 is a schematic view of a partial assembly of FIG. 7.
Figure 9:
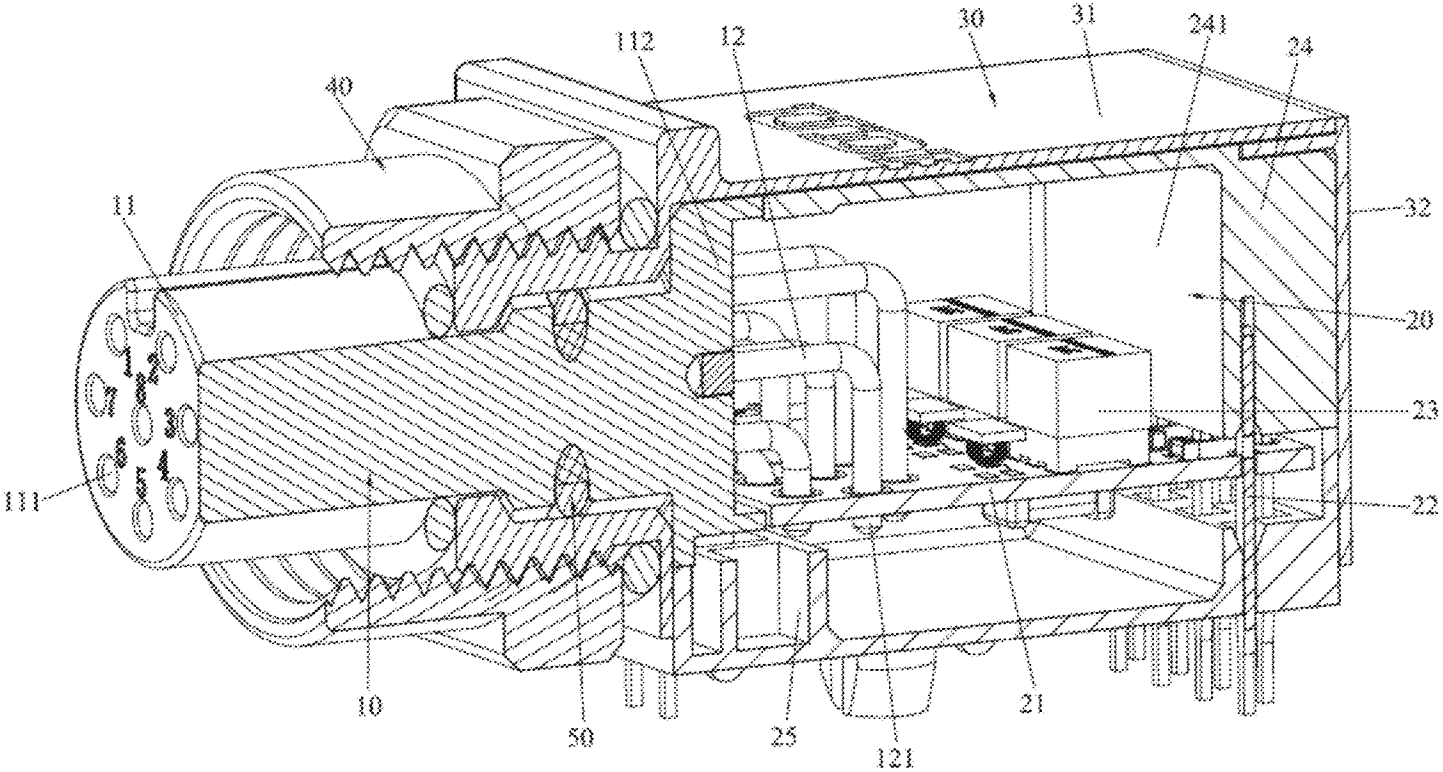
FIG. 9 is a first cross-sectional view of an electrical connector with a filtering function in accordance with the present invention.
Figure 10:
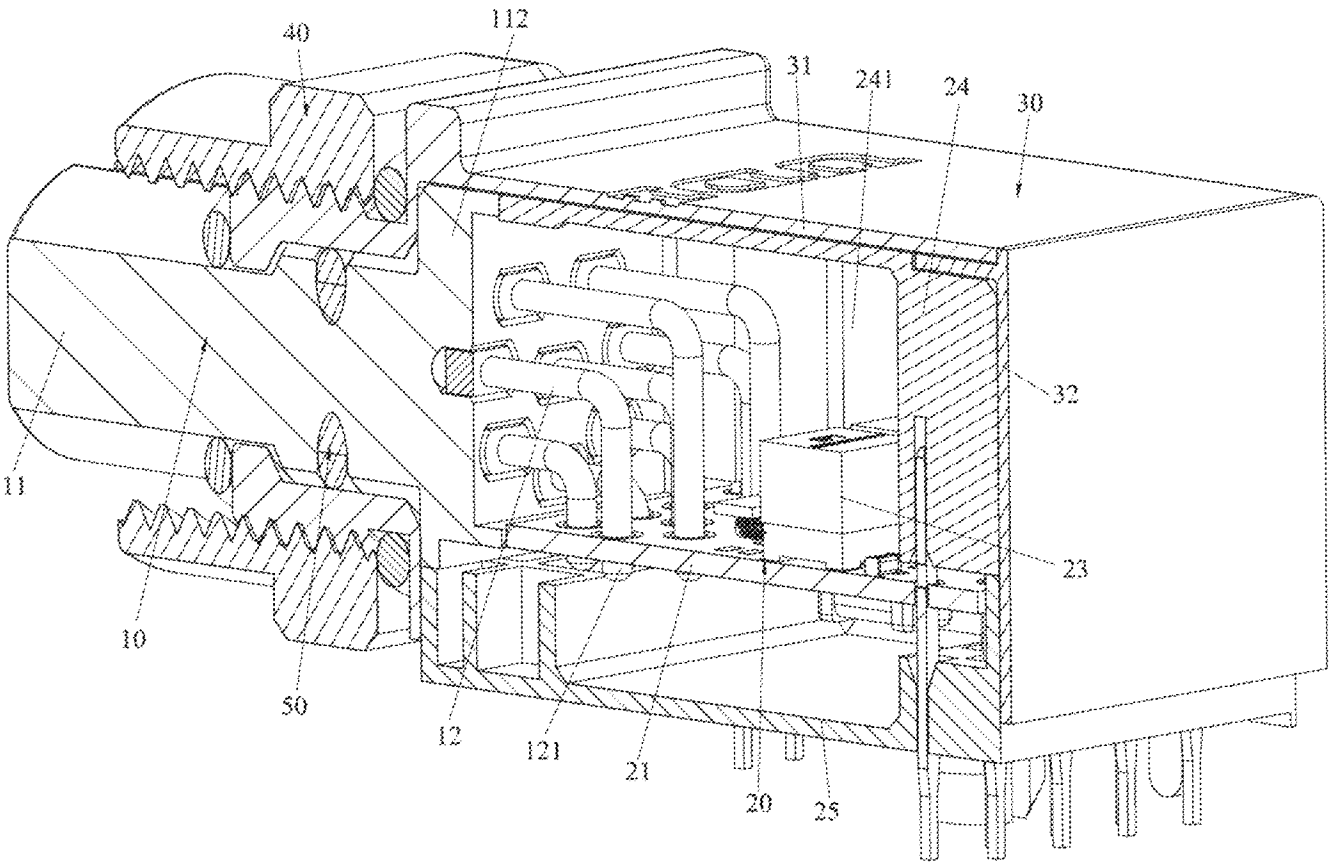
FIG. 10 is a second cross-sectional view of an electrical connector with a filtering function in accordance with the present invention.
Figure 11:
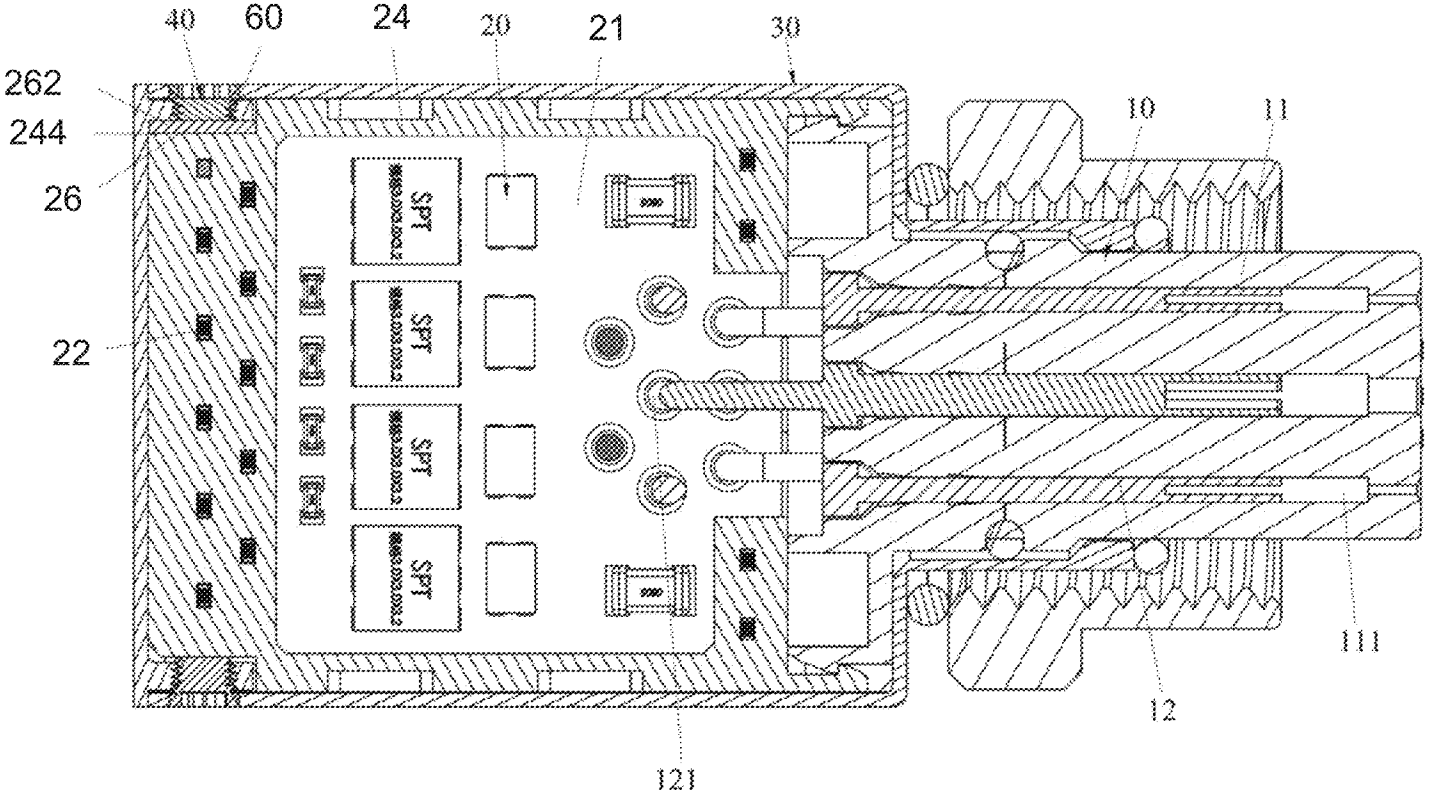
FIG. 11 is a third cross-sectional view of an electrical connector with a filtering function in accordance with the present invention.

With reference to FIGS. 1 to 11, FIG. 1 shows a schematic view of an assembly of an electrical connector with a filtering function in accordance with the present invention, FIG. 2 shows a first exploded view of the electrical connector with a filtering function of the invention, FIG. 3 shows a second exploded view of the electrical connector with a filtering function of the invention, FIG. 4 shows a schematic view of a partial assembly of FIG. 3, FIG. 5 shows a schematic view of a partial assembly of FIG. 4, FIG. 6 shows a schematic view of a partial assembly of FIG. 5, FIG. 7 shows a schematic view of a partial assembly of FIG. 6, FIG. 8 shows a schematic view of a partial assembly of FIG. 7, FIG. 9 shows a first cross-sectional view of the electrical connector with a filtering function in accordance with the invention, FIG. 10 shows a second cross-sectional view of the electrical connector with a filtering function in accordance with the invention, and FIG. 11 shows a third cross-sectional view of the electrical connector with a filtering function in accordance with the invention.

In the aforementioned schematic, exploded, and cross-sectional views of the assembly of the present invention, the electrical connector with a filtering function (hereinafter referred to as an "electrical connector") comprises: a high-speed interface 10, a filter module 20 and a hood 30, and the high-speed interface 10 is electrically coupled to the filter module 20, and the hood 30 covers the exterior of the high-speed interface 10 and the filter module 20.

The high-speed interface 10 comprises an insulating body 11 and a plurality of connecting terminals 12, wherein the insulating body 11 has a plurality of through holes 111 formed thereon, and an end of the insulating body 11 has a substantially circular cross-section, and a frame 112 is integrally formed at an edge of the circular cross-section of the insulating body 11. In addition, the connecting terminals 12 are installed and configured to be corresponsive to the through holes 111 respectively and extended backwardly from the circular cross-section of the insulating body 11 and bent downwardly to form a plurality of soldered ends 121. In this embodiment, the high-speed interface 10 includes a M12 interface; the frame 112 is disposed at a rear end of the insulating body 11; and both sides of the frame 112 have a latch slot 113.

The filter module 20 is installed at the rear end of the circular cross-section of the insulating body 11, and the filter module 20 includes a horizontally configured PCB 21, and a lid 24 with a plurality of output terminals 22 and a grounding terminal 26, and the PCB 21 is electrically coupled to the output terminals 22 and the grounding terminal 26, and the soldered ends 121 is also electrically coupled to the PCB 21.

More specifically, the PCB 21 has a plurality of electronic components 23 installed thereon, and the lid 24 has an accommodating cavity 241 concavely formed on the bottom of the lid 24, and the lid 24 is inlaid and combined with the frame 112. In addition, both sides of the front end of the lid 24 have a positioning portion 242 configured to be corresponsive to the respective latch slot 113 on both sides of the frame 112, and the positioning portion 242 is latched into the latch slot 113.

In this embodiment, the electronic components 23 installed on the PCB 21 are accommodated into the accommodating cavity 241, and the plurality of output terminals 22 are latched onto the lid 24. In addition, the output terminals 22 include a plurality of POE terminals 221 installed on both sides of the front end of the lid 24. More specifically, two POE terminals 221 are disposed on both sides of the front end of the lid 24 respectively.

In addition, a notch 243 is formed at the middle of the front end of the lid 24 and configured to be corresponsive to the soldered ends 121, and the soldered ends 121 is passed through the notch 243 and extended into the lid 24, and the soldered ends 121 and the output terminal 22 are perpendicular to the bottom surface of the lid 24. Further, the filter module 20 further comprises a base 25 engaged with the bottom of the lid 24, and the PCB 21 is clamped between the base 25 and the lid 24, and the output terminals 22 are extended out from the bottom surface of the base 25.

On the other end, the hood 30 covers the circular cross-section of the insulating body 11 and the filter module 20, and the output terminals 22 are extended out from the bottom surface of the hood 30, and the hood 30 includes a front casing 31 and a rear cover 32, wherein the front casing 31 has an accommodating cavity 301, and the front casing 31 has a penetrating hole 302 formed on the front side of the front casing 31 and communicated with the accommodating cavity 301. In addition, the rear cover 32 covers the rear opening of the accommodating cavity 301, and the front casing 31 is fixed and coupled to the rear cover 32 through a locking screw 33, and the front end of the hood 30 is screwed and coupled by a nut 40.

The grounding terminal 26 includes a first connecting end 261 electrically coupled to the PCB 21 and a second connecting end 262 integrally coupled to the first connecting end 261, and attached onto the external surface of the lid 24. In addition, the hood 30 covers the lid 24 and has a screw hole 60 configured to be corresponsive to the second connecting end 262. In addition, the locking screw 33 is screwed into the screw hole 60 to press and connect the second connecting end 262 of the grounding terminal 26, and the grounding terminals 26 are electrically coupled to the hood 30 through the locking screw 33.

In the present invention, at least a terminal slot 244 is formed on the external surface of the lid 24 and configured to be corresponsive to the second connecting end 262 of the grounding terminal 26, and the second connecting end 262 is accommodated into the terminal slot 244 to make the hood 30 smoother and flatter to prevent it from being warped during the process of screwing the locking screw 33.

In FIGS. 1 to 11, the electrical connector with a filtering function of the present invention is assembled by the following process. Firstly, the output terminals 21 and the grounding terminal 26 are installed onto the lid 24, and then the output terminals 21 and the grounding terminal 26 are soldered and conducted with the PCB 21. After the aforementioned steps are completed, the lid 24 with the output terminals 22 is installed at a rear end of the circular cross-section of the high-speed interface 10 to latch the positioning portion 242 of the lid 24 into the latch slot 113 of the frame 112 of the high-speed interface 10, and the soldered end 121 of the plurality of connecting terminals 12 is passed into the notch 243 of the lid 24 and extended into the lid 24, so as to install the connecting terminals 12 to the insulating body 11 and engage and fix the insulating body 11 with the lid 24.

Secondly, the PCB 21 electrically coupled to plurality of electronic components 23 is installed horizontally to the bottom of the lid 2, and the plurality of soldered ends 121 and the plurality of output terminal 22 are electrically coupled to the PCB 21, and the base 25 is latched to the bottom of the lid 24, and the PCB 21 is clamped between the lid 24 and the base 25, and the plurality of output terminals 22 are extended out from the bottom surface of the base 25.

The plurality of silicone washers 50 are sheathed on the middle of the high-speed interface 10, and the front casing 31 is installed from the front to the rear of the high-speed interface 10 to cover the circular cross-section of the high-speed interface 10, the lid 24, and the base 25. The rear cover 32 is covered onto the rear end of the front casing 31 and fixed by the locking screw 33, and the plurality of output terminals 22 are extended out from the front casing 31 and the bottom of the rear cover 32, and the silicone washers 50 are sheathed on the front end of the high-speed interface 10.

Finally, the locking screw 33 is screwed tightly into the screw hole 60 to press onto the second connecting end 262 of the grounding terminal 26, and the grounding terminal 26 is electrically coupled to the hood 30 through the locking screw 33, so as to complete the assembling of the electrical connector with a filtering function in accordance with the present invention.

The major technical characteristic of the present invention resides on that the PCB is electrically coupled to the electronic components and horizontally installed into the electrical connector, and both of the connecting terminal and the output terminal are electrically coupled to the PCB to improve noise resisting ability and adapt high-speed transmissions, and achieve the effects of ensuring the miniaturization of the electrical connector, so that the present invention has the advantages of simple and compact structure, easy manufacture and low cost.

In addition, another major technical characteristic of the present invention resides on that the first connecting end of the grounding terminal is electrically coupled to the PCB, and the second connecting end is attached onto the external surface of the lid, and the hood covers the lid and has the screw hole formed thereon and configured to be corresponsive to the second connecting end, and the locking screw is screwed into the screw hole to press and connect the second connecting end of the grounding terminal, and the grounding terminals are electrically coupled to the hood through the locking screw, so as to effectively overcome the drawbacks of the conventional complicated structure for grounding electrical connectors, occupying too much space, and having unreliable electrical connections.

While the invention has been described by means of specific embodiments, numerous modifications and variations could be made thereto by those skilled in the art without departing from the scope and spirit of the invention set forth in the claims.

What is claimed is:

1. An electrical connector with a filtering function, comprising:

a high-speed interface (10), further comprising:

an insulating body (11), having an end with a circular cross-section, and a plurality of through holes (111); and a plurality of connecting terminals (12), installed into the through holes (111) respectively, extended backwardly from the circular cross-section of the insulating body (11) and bent downwardly to form a plurality of soldered ends (121);

a filter module (20), installed at a rear end of the circular cross-section of the insulating body (11), and including a lid (24) with a plurality of output terminals (22) and at least a grounding terminal (26), and a PCB (21) electrically coupled to the output terminals (22) and the grounding terminal (26) and configured horizontally; and a hood (30), covering the circular cross-section of the insulating body (11) and the filter module (20);

wherein, the PCB (21) has a plurality of electronic components (23) installed thereon; and the output terminals (22) are extended out from a bottom surface of the hood (30);

wherein, the grounding terminal (26) includes a first connecting end (261) electrically coupled to the PCB (21) and a second connecting end (262) integrally coupled to the first connecting end (261), and the second connecting end (262) is attached onto an external surface of the lid (24);

wherein, the hood (30) covers the exterior of the lid (24), and has a screw hole (60) formed at a position of the hood (30) and configured to be corresponsive to the second connecting end (262);

wherein a locking screw (33) is screwed tightly into the screw hole (60) to press and connect the second connecting end (262) of the grounding terminal (26), and the grounding terminal (26) is electrically coupled to the hood (30) through the locking screw (33).

2. The electrical connector with a filtering function of claim 1, wherein the external surface of the lid (24) has at least a terminal slot (244) formed thereon and configured to be corresponsive to the second connecting end (262) of the grounding terminal (26), and the second connecting end (26) is accommodated into the terminal slot (244).

3. The electrical connector with a filtering function of claim 1, wherein the insulating body (11) has a frame (112) integrally formed at an edge of the circular cross-section of the insulating body (11).

4. The electrical connector with a filtering function of claim 1, wherein the filter module (20) further includes a base (25) latched to the bottom of the lid (24), and the PCB (21) is clamped between the base (25) and the lid (24), and the output terminals (22) are extended out from the bottom surface of the base (25).

5. The electrical connector with a filtering function of claim 1, wherein the hood (30) includes a front casing (31) and a rear cover (32), and the rear cover (32) covers a rear opening of the front casing (31), and the front casing (31) is fixed and coupled to the rear cover (32) through the locking screw (33).

6. The electrical connector with a filtering function of claim 1, wherein the high-speed interface (10) includes a M12 interface.

7. The electrical connector with a filtering function of claim 6, wherein the lid (24) of the filter module (20) is inlaid and combined with the frame (112), and the output terminals (22) are latched onto the lid (24); the front end of the lid (24) has a notch (243) formed thereon and configured to be corresponsive to the soldered ends (121); the soldered ends (121) are passed through the notch (243) and extended into the lid (24), and the soldered end (121) and the output terminals (22) are perpendicular to the bottom surface of the lid (24) and electrically coupled to the PCB (21).

8. The electrical connector with a filtering function of claim 7, wherein the frame (112) has a latch slot (113) formed on both sides of the frame (112) each, and the lid (24) has a positioning portion (242) disposed on both sides of the front end of the lid (24) and configured to be corresponsive to the latch slot (113), and the positioning portion (242) is latched into the latch slot (113).

9. The electrical connector with a filtering function of claim 7, wherein the output terminals include a plurality of POE terminals (221) installed on both sides of the front end of the lid (24).

10. The electrical connector with a filtering function of claim 7, wherein the lid (24) has bottom an accommodating cavity (241) concavely formed on the lid (24) for accommodating the electronic components (23) installed on the PCB (21).

* * * * *